US010087640B2

(12) United States Patent
Kraskov

(10) Patent No.: US 10,087,640 B2
(45) Date of Patent: Oct. 2, 2018

(54) SMOOTHING TOOL

(71) Applicant: Leonid Kraskov, Seaford (AU)

(72) Inventor: Leonid Kraskov, Seaford (AU)

( * ) Notice: Subject to any disclaimer, the term of this patent is extended or adjusted under 35 U.S.C. 154(b) by 149 days.

(21) Appl. No.: 15/048,710

(22) Filed: Feb. 19, 2016

(65) Prior Publication Data

US 2016/0244983 A1 Aug. 25, 2016

(30) Foreign Application Priority Data

Feb. 19, 2015 (AU) ..... 2015900640

(51) Int. Cl.
*E04F 21/16* (2006.01)
*E04F 21/165* (2006.01)

(52) U.S. Cl.
CPC ..... *E04F 21/1655* (2013.01); *E04F 21/1652* (2013.01)

(58) Field of Classification Search
CPC ..... E04F 21/1655; E04F 21/1652
See application file for complete search history.

(56) References Cited

U.S. PATENT DOCUMENTS 2,594,606 A * 4/1952 Ames ..... E04F 21/1655 401/11
2,824,443 A * 2/1958 Ames ..... B05C 17/00516 401/13
4,451,223 A * 5/1984 Mower ..... E04F 21/1655 425/458
5,423,666 A * 6/1995 MacMillan ..... E04F 21/1655 15/235.7
6,155,809 A * 12/2000 Edwards ..... B05C 17/00503 15/235.7
7,182,587 B1 * 2/2007 Raney ..... E04F 21/1655 15/235.7
9,149,829 B2 * 10/2015 Gill ..... B05C 11/00

FOREIGN PATENT DOCUMENTS

AU 2013100174 3/2013

* cited by examiner

*Primary Examiner* — Randall Chin
(74) *Attorney, Agent, or Firm* — TraskBritt, P.C.

(57) ABSTRACT

Described is a trowel having wings made from a pentagonal blank of stainless steel sheet that is typically 1.2 mm thick and bent about its central minor axis to include an angle theta of 105 degrees. The end of each wing has a peak at its outermost lateral extremity relative to the central axis. The part of the wing between the peaks and a working edge is bent toward the front of the trowel and, in use, is oriented toward the drywall panels. An elevated trailing edge of each wing has a narrow flange, respectively, which again points frontward and, in use, toward the panels. The flanges have radiused ends for smoothing the edges of the compound.

15 Claims, 3 Drawing Sheets

SMOOTHING TOOL

PRIORITY CLAIM

This application claims the benefit of the filing date of Australian Provisional Patent Application Ser. No. 2015900640, filed Feb. 19, 2015, for "Smoothing Tool," the contents of which are incorporated herein by this reference.

TECHNICAL FIELD

This application concerns a trowel for finishing internal corners of building interiors and associated means and methods.

BACKGROUND

A variety of tools have been described for assisting in the finishing work for internal corners of dry wall panels in building interiors. The appearance of the interior to some extent relies upon the success or otherwise of the joint formation and finish. This is because the finishing work sequence may involve the mixing of plaster, the application of plaster, the smoothing of plaster, the drying of plaster, the sanding of the dried plaster and the brushing of the dried plaster.

In the Applicant's Innovation Patent No. 2013100174 (published Mar. 21, 2013), a hand pump is described for extruding a bead of comparatively viscous, water-based plaster. This pump has a nozzle that deposits a continuous bead of plaster into the corner. The volume of plaster deposited in this way is calculated to be sufficient to cover the dry paper tape applied beforehand to the edges of the drywall panels but not much of the panel's surface. A smoothing trowel called a corner glazer may be mounted on a handle, which allows the trowel to articulate when used to smooth the plaster. This arrangement relies on integral springs to resist deformation of wings of the glazer. However, if viscous plaster is used, the tool tilts off center and wing concavity forms convex strips in the carrier, which is inconvenient, and incurs additional cost, labor, time, and extra compound, requiring further sanding.

BRIEF SUMMARY

In one aspect, there is provided:

A trowel for finishing internal corners formed by drywall panels, the trowel comprising:

- a body comprising a pair of substantially rigid panels forming wings joined at a reflex angle at a corner having a corner axis, and presenting an L-shaped outer working surface, an attachment on the reverse surfaces being the oblique side of the wings for receiving and retaining a detachable handle,
- wherein the wings each have a slot extending from a central area of the wing toward the corner.

Angles referred to in this specification may include reflex (>180 degrees), straight (180 degrees), and oblique including obtuse (90-180 degrees), right or normal (90 degrees) and acute (<90 degrees). The trowel may be used to apply a viscous material, such as a wet mix solution, compound, suspension and/or mixture, to an interior wall and/or ceiling panel. The material may be a topcoat or plaster mix. The trowel may permit the operator to apply a single layer of the material to the interior wall and/or ceiling panel. The material may have a viscosity of 1500-10,000 cps, preferably 2,500-5,000 cps, and most preferably about 3,000-4,000 cps.

Ideally, the material has as high viscosity as is commercially available. Preferably, little to no water is added to the compound preparation, thus achieving an improved finish when applied to a surface, with no or minimal shrinking or cracking, and maintenance of the manufacturer's warranty.

The slot may be in the form of an incision or cutout. The slot may be formed by an incision. The slot preferably defines a narrow gap. The slot on each wing may extend between a pair of spaced locations intermediate the wing. The slot may extend from the central area of one wing to the central area of the other wing, passing through the corner. The slot may be linear or curved. The slot may extend at a substantially right angle to the corner axis. The incision may be 0.2-0.5 mm wide. The gap defined by the slot may be sufficient to allow the tool to flex but not enough to allow plaster to pass through the incision. The width of the slot may vary along its length, for example, being wider nearer to the outer extremities and narrower closer to the corner. The width of the slot is preferably consistent throughout its length. The slot may extend an equal distance either side of the corner in order to produce quality work on both sides of the corner.

Each panel member of the pair of wings may be planar in shape, at least presenting a pair of flat surfaces joined together and set at an oblique angle relative to one another. Each panel member may be square, triangular, partially round or semicircular in shape. The wings may be made of metal, such as stainless steel, aluminum, or plated or coated metal, or may be made from a stiff polymer, such as acetal. Preferably, the pair of panels are made of metal.

The panels may be the same size and identical in shape (the mirror images thereof), or may be different from one another, particularly where a larger wing is required for a wall panel lying in a vertical plane and joined to a substantially horizontal ceiling panel.

The wings may be formed from molded plastic, cast metal or machined metal or plastic, for example, using a Computer Numerical Control (CNC) device.

The pair of panels are preferably integrally and/or unitarily formed from the same material, sheet or piece. The joint or corner may comprise material continuous with the wings.

The wings may be 50-150 mm wide and 50-150 mm long. Preferably, each of the wings is 85-110 mm long. The wings may be made from a stainless steel sheet about 1-2 mm thick, more preferably 1.0-1.5 mm thick, and the preferred thickness is about 1.0-1.2 mm. This is because, at the preferred ranges of thickness, the force applied by the operator may be sufficient to bend the wings to conform to the angle of the oblique angled corner formed by the drywall panels ("interior wall corner").

This allows the operator to maintain the right wall and ceiling angles without damaging the surface of the wall or ceiling panel. A central force is imposed through the handle, and thereby produces desirable angles and plane surfaces of the worked compound without the trowel swaying to the left or to the right, nor resulting in concaving, etc., unlike what is produced using existing prior art tools.

The angle of the interior wall corner determines the internal joint angle dictated by the relative orientation of the respective panel surfaces by urging the flexed alignment of the panels with the respective planes of the interior walls. However, the rigidity, which is partially a function of the panel's thickness, is preferably sufficient to resist the imposition of curvature on the wings as they compress a wet, viscous topcoat. The panel thickness is also relevant because it means that the trowel does not require the use of springs like prior art tools do. Preferably, the leading edge of each wing includes ridges or stamps, each ridge extending laterally from the corner and aligned near or adjacent the edge. This assists in resisting the wings taking a concave form by providing a fold or stamp that improves the lateral rigidity of the wings on one longitudinal slide of the slot.

The determined thickness of the panels, preferably made of stainless steel, confers on the operator the ability not only to keep pressure against the wall during operation to obtain a thick undiluted topcoat under the pressure of the trowel, but for the trowel panels to also return to their original form and relative position after operation, being resiliently deformable in operation to conform to the shape and angles of the interior wall corners, but also sufficiently resistant to deformation to achieve a smooth and consistent finish in applying the thick topcoat. Other prior art tools require springs to maintain pressure against interior wall and/or ceiling panel during operation. However, they typically achieve this by applying a thin, heavily diluted topcoat, while being capable of returning to its original configuration. However, if the top coat is heavily diluted, this may void the compound manufacturer's warranty. The thick topcoat proposed to be used under this disclosure would not be workable with such prior art tools. As a result of the resistance imparted by the material, such prior art tools lift off or away from the wall and can result in the use of undesirable and uncontrolled amounts of topcoat. Such prior art devices will also lose their original form and configuration, distorted by the strong forces to which the tool is subjected as a result of the high viscosity of the material.

The penalty for allowing such curvature inherent in prior art tools is to create one or more convex plaster bands in the interior wall corner area, which require uneconomical periods of drying time and sanding to remove.

The resulting stiffness of the wings, advantageously produced from thick steel, the provision of rigidity (conferring ridges or stamps), the cutouts or slots, and the welded spine or block, allow for excellent central flexing. Combined with the ease with which the wings bend about the corner axis, this allows the tool made according to the preferred embodiment to mimic or follow the angle of the interior wall corner with high precision.

The wings may each have a leading edge. The leading edge may be curved. The leading edge may present a convex curved edge. The leading edge may have two or more straight edges set at a reflex angle. Preferably, however, the leading edge includes a straight surface. The leading transverse edges of the wings may have a flange that is inclined toward the drywall panel forming the internal corner. The flange may lie at an obtuse angle to the working surface of each wing. The trailing edges of the wings may lie parallel to the leading transverse edges. The two ends of each flange may be radiused.

The working face of each wing may have a skid for contacting the drywall panels. The skid may be disposed parallel to the corner axis and spaced from the corner axis in order to be advantageously spaced from the central wet plastered band of the internal corner. The skid preferably has an inclined face for contacting the coated panels and is intended to present the wings at a suitable smoothing angle and to hold excess mix without spillage to be reused.

The skids may extend across the face of each wing from a working edge to the flanged elevated leading edge. The skids may be tapered. The deepest part of the skid may be adjacent to the flange.

This ensures that when a preferred form of the disclosure is applied to a band of material in the form of a wet mix adheres to the interior wall corner area between two drywall panels. The working edge touches the wall first, together with the skids, and then pushes the mix out toward the outer edges of each wing. This action simultaneously forms an internal planar surface, the lower working edge smoothing the wet mix as the trowel advances along the corner axis. The elevated flanged leading edge preferably does not touch the wall. The skids preferably keep the elevated flanged leading edge off (spaced from) the wall. A little wet mix may reach close to the outer edge of each wing. The outermost wet mix may be recessed from about 5-15 mm from the lateral outer edges. For example, the wet mix may extend 100 mm or so from the corner axis.

The trowel may be supplied with a handle fixed to the body. The handle may be detachable so that both short and long handles can be separately used with the same body of the trowel. The attachment means for receiving and retaining the handle may be a ball socket with an adjacent spring seat for a ball-retaining spring that traps the ball in the socket while allowing universal movement of the handle to which the ball is fixed.

The socket may be a prism-shaped spine with the apex opposite and aligned with the corner axis of the wings. The attachment may comprise a rectangular base area. The base area may have a pair of parallel slots acting as a spring seat. The spring may be an inverted, substantially U-shaped, wire spring that slides into the slots. The spring may be constantly retained or trapped within the prism. The ball may simply clip into the prism and may be removed in reverse by an operator when the work is finished. Substantial friction is preferably provided by a close fit between the ball, socket and spring, so that when the tool becomes heavy with compound, it may still be gripped firmly and does not rotate uncontrollably around the ball like prior art tools do, but, instead, rotates slowly against resistance around the ball only when forced to rotate, even laden with wet mix when the trowel is slid along the wall or when the wall is used to realign it to start sliding again along a different interior wall corner.

The spine may be a steel component. The spine may be attached to a prismatic block. The block may be welded to the reverse surfaces of the wings.

The prismatic block may be welded to the wings such that the top edge of the block is level with the slots. This allows for the body to flex centrally about the corner and forward of the slot toward the elevated leading edge without damage to walls. The ball socket accordingly may lie on the opposite side of the slot. The handle may apply a smoothing force through the spine and the spine may transmit the force to the leading edge or working end of the spine. This may cause the corner zone joining the wings to flex and follow the angle of the interior wall corner, and at the same time filling hollows, dents, cover lines, lumps, bumps, ripples, creases, etc.

This construction allows the trowel and its wings to apply wet mix smoothly to interior wall corners with internal angles of 85-105 degrees without producing concavity in the plastered band.

The trowel is preferably made of one piece of steel folded at the center, creating a pair of wings or panels. In use, all central force may rely on the corner fold, the slot, the welded prism, and the thickness of the steel sheet from which the wings are made, to spread out the compound evenly. No springs are required, unlike existing prior art tools. Other prior art tools rely on springs and, furthermore, because they are of thin steel construction, they either lean to the left or put pressure on the right side of the wings, thus forming a regular finished work.

The advantages of this disclosure enable the trowel to assist in the subsequent sanding operation, which proceeds efficiently and with expedition because of the planar surfaces achieved on the exposed surface of a dried wet mix allowed to cure after application. It also makes the sanding operation "productively safer" than achieved using other prior art devices because the paper tape laid down in preparation is well covered with top coat that was viscous in application and that has not been watered down. This allows many tradespeople to use a sanding machine safely and avoiding over-sanding, which can occur inadvertently and rapidly.

Advantageous Effects of Some Aspects of the Disclosure

1. Produces a plastered internal corner in one pass. If the corner angle is not constant or has recessed edges, as may be the case using prior art devices, a second pass may be needed to push mix out beyond the tape and fill the recessed edges consistently.

2. Can smooth viscous material mixes, which, in turn, obviate splatter. This action fills hollows, recesses, hammer dents and screw holes.

3. Superior looking finish compared to a machine finish that produces bands that are about 75 mm or 90 mm wide with mobile mixes that cause high shrinkage and cracking. Excess compound is generally reusable.

4. Overcomes poor taping practices. Useful for corners between walls and ceilings. Efficiently smooths vertical joints. Smooths top coats. Excellent paper tape coverage.

5. Taping and application of topcoat on the same day is generally achievable only if a base coat for taping is used in the prior art. A 100 mm wide finish is what is taught at trade schools and this is the finish obtained by the trowel of the disclosure. The trowel obviates the need for mechanical springs to produce necessary flexing of the wings. The trowel will smooth corners with angles of between about 85-105 degrees. The finished coat blends into repair work done to painted surfaces. Diluted compounds in other machines or using other prior art tools cannot blend the work because they tend to pinhole or bubble the paintwork. Shrinkage occurs where the paper repair meets with the painted surface.

BRIEF DESCRIPTION OF THE DRAWINGS

One embodiment of the disclosure is now described with reference to the accompanying drawings, in which.

DETAILED DESCRIPTION

Preferred features of this disclosure will now be described with particular reference to the accompanying drawings. However, it is to be understood that the features illustrated in and described with reference to the drawings are not to be construed as limiting on the scope of the disclosure, except as may be recited in the claims accompanying this specification.

Figure 2:
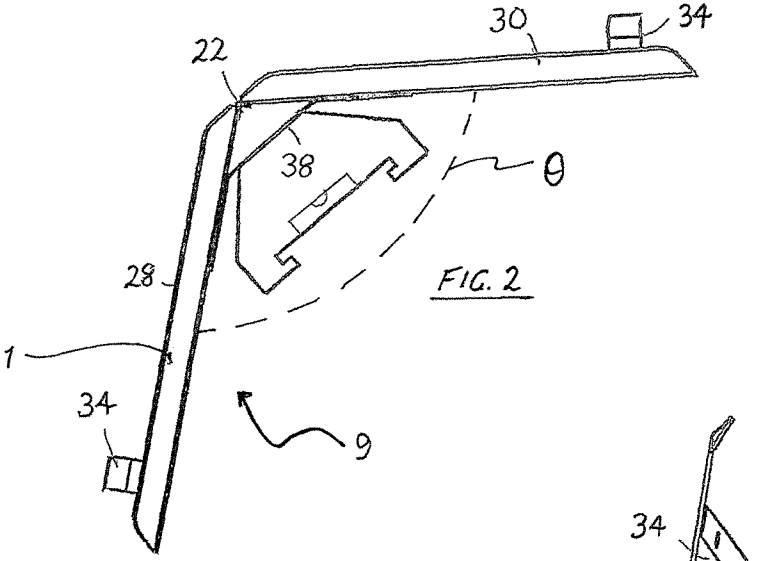
FIG. 2 is an underneath plan view of the trowel shown in FIG. 1.
Figure 3:
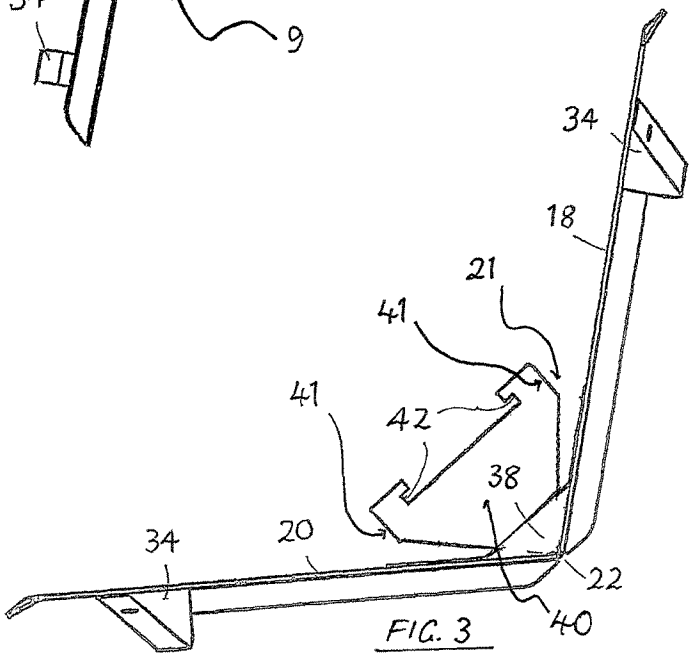
FIG. 3 is a top plan view of the trowel shown in FIG. 1.
Figure 1:
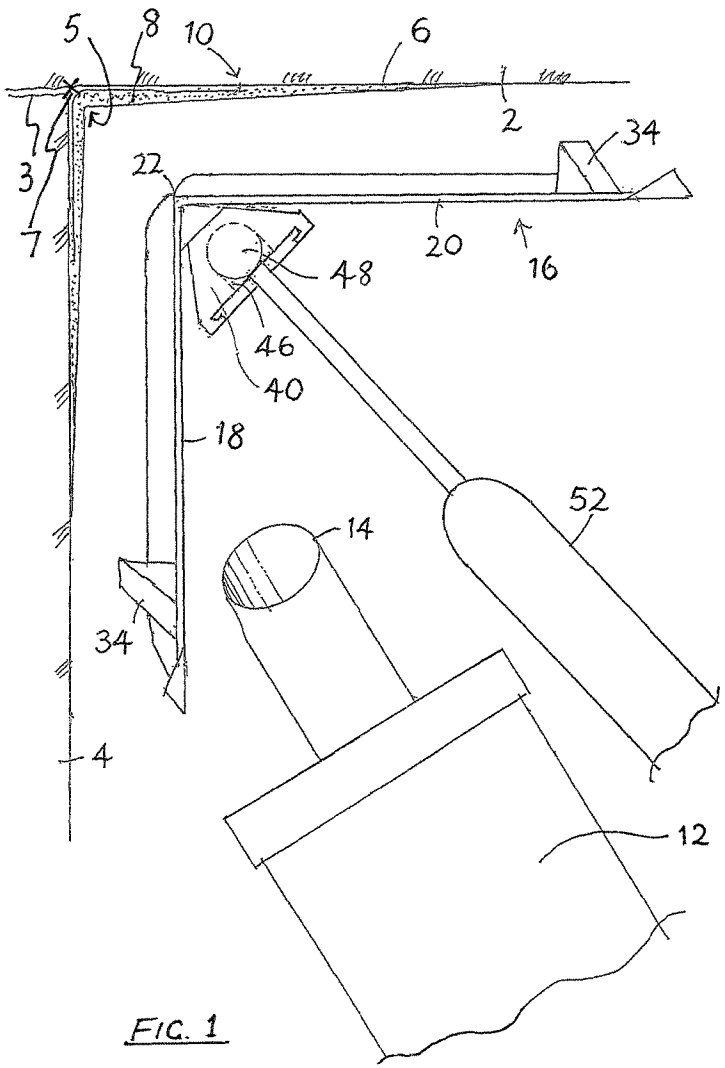
FIG. 1 is a cross-section through an internal corner showing tape, plaster and a trowel made according to one embodiment of the disclosure.
Figure 4:
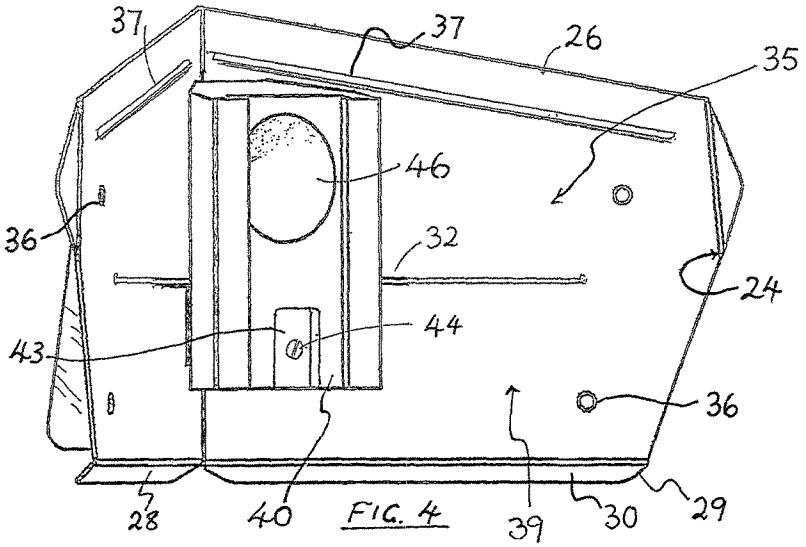
FIG. 4 is a rear perspective view of the trowel shown in FIG. 1.
Figure 5:
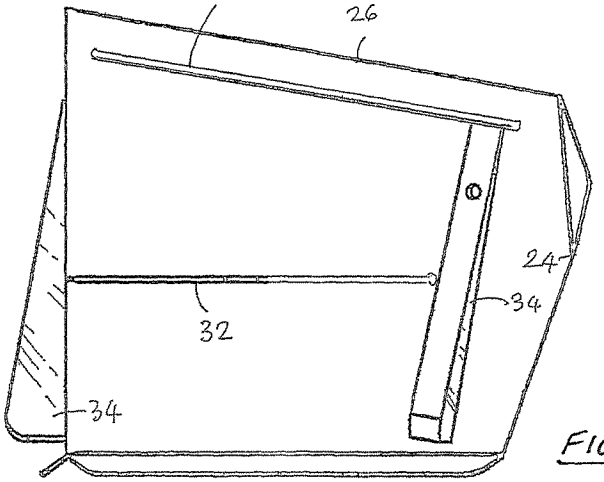
FIG. 5 is a side view of the trowel shown in FIG. 1.
Figure 6:
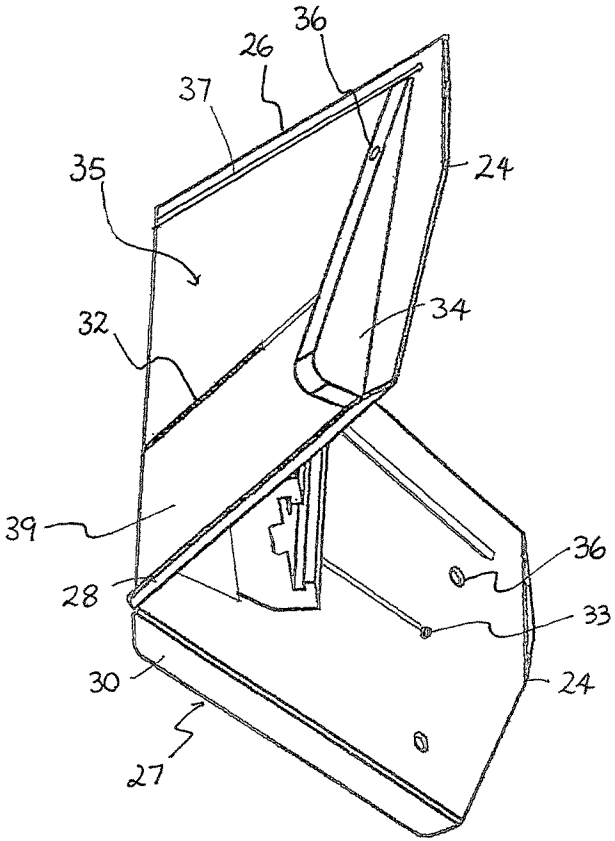
FIG. 6 is an underneath perspective view from the front of the trowel shown in FIG. 1.
Figure 7:
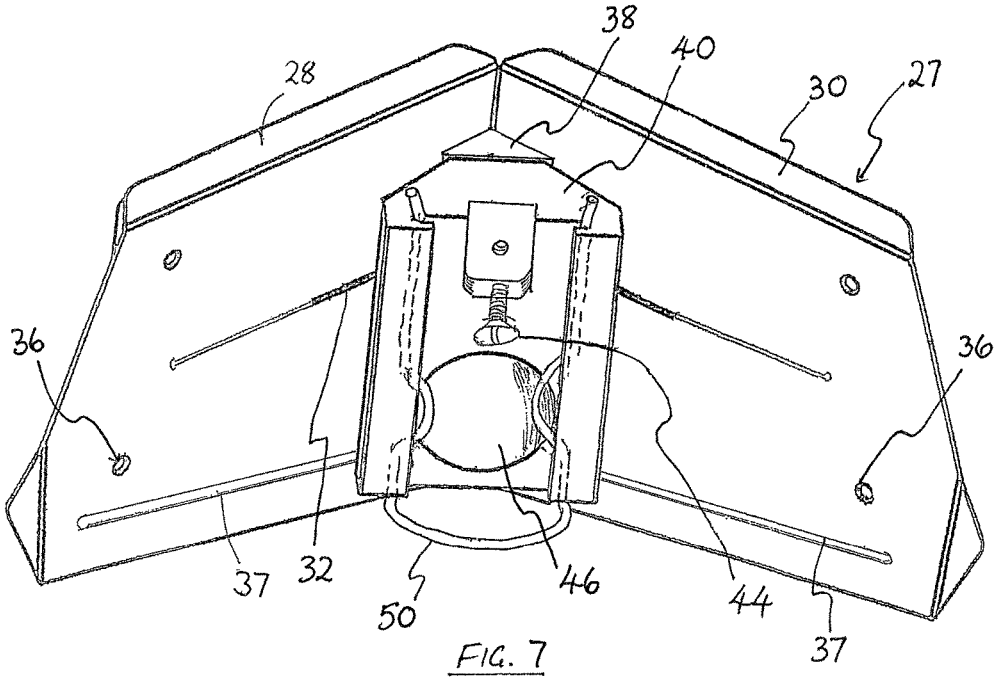
FIG. 7 is a rear perspective view of the trowel shown in FIG. 1.
Figure 8:
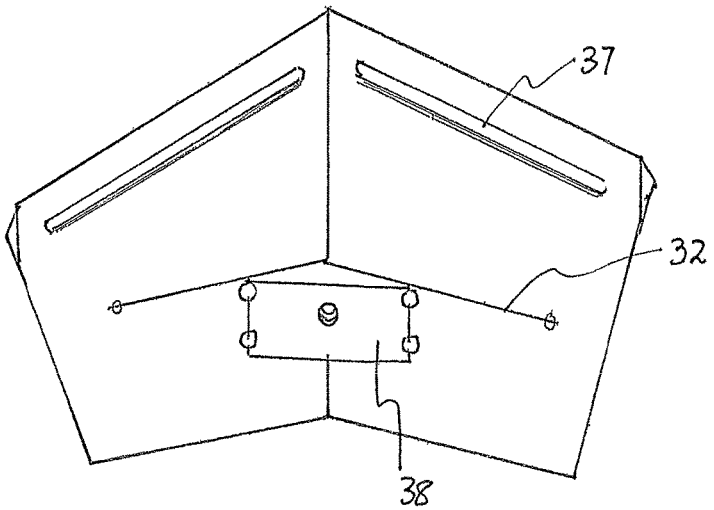
FIG. 8 is a rear top perspective view of the trowel shown in FIG. 1.

Referring first to FIG. 1, a pair of drywall panels 2, 4, such as wall or ceiling panels, intersect at about 90 degrees, although the interior wall or ceiling corner angle ("internal wall corner") 5 can vary, of course, depending on architecture and movement over time. When the corner is external, metal beading may be used to protect an edge of the panels, but in an internal wall corner 5 as shown in FIG. 1, the walls 2, 4 intersect as shown. A joint 3 at the meeting of the drywall panels 2, 4 is sealed by the adhesion of panel tape 6 affixed manually or by machine. The tape 6 is 50 mm wide and is positioned symmetrically on a corner axis 7, being the axis of the internal wall corner 5.

A material in the form of a plaster mix 8 is applied to hide the edges 10 of the tape 6. This plaster mix 8 is viscous but soft and pliable in its composition and, therefore, a sanding operation with a sanding disc and/or block may be used to finish the work to achieve a smooth surface presentation.

The plaster mix 8, commonly referred to as "compound," has high water content and behaves as a mobile gel, rather than a paste like a cement mix, and frequently dries with unacceptable cracks. A pump 12 is described in the Applicant's published Innovation Patent No. 2013100174 (the entire contents of which are incorporated herein by reference) and deposits compound 8 through a nozzle 14, to form a bead of compound 8 of a suitable diameter for smoothing by a trowel 16 made according to the disclosure in the corner 5. This is because the finished joint 3 is slightly larger in compound 8 depth than what would be obtained by machine finishes or hand-built corners. Using the trowel 16, cracks are easily sanded away using a hand sanding block (not shown).

Referring now to FIGS. 2-8, the trowel 16 has wings 18, 20 made from a pentagonal blank sheet of stainless steel that is 1.2 mm thick and bent about its central minor axis 22 to include an angle theta (θ) of 105 degrees. The end of each wing has a peak 24 at its outermost lateral extremity relative to the central axis 22. The part of the wing 18, 20 between the peaks 24 and a working edge 26 is bent toward the front of the trowel and, in use, is oriented toward the drywall panels 2, 4. An elevated trailing edge of each wing 18, 20 has a narrow flange, respectively 28, 30, which again points frontward and, in use, toward the panels 2, 4. The flanges 28, 30 have radiused ends 29 for smoothing the edges of the compound 8. The radiused ends 29 also assist in maintaining the shape of the trowel 16 when in use, for example, enabling the trowel to bend back to its original position and to hold its strength when used on the viscous compound. The radiused end 29 is shaped to stay up and spaced from the wall or ceiling panel, and provides strength- and shape-maintaining functions.

Flexing about minor axis 22 is determined by the thickness of the wings 18, 20 made from sheet steel. The shape of the body 1 of trowel 16 and a prismatic block 38 also determine the degree of flexing of the wings 18, 20. The prismatic block 38 is a wedge block located in the small of the oblique corner 21 of the trowel 16 and resists flexing. A slot or incision 32 radially extending either side of the corner axis 22 facilitates greater flexing through the width of the wings 18, 20 to the outer peaks 24. Together, these help achieve a flexing range of the oblique trowel corner 21 from 105 degrees to 85 degrees. This is the general range through which internal wall corners 5 exhibit. The working edge 26 stays mainly stiff and effects the smoothing of the compound 8. Attached to the prismatic block 38 is a wedge block 40, located in the small oblique corner 21 of the trowel 16 in order to resist flexing of the body, both laterally about the corner and mainly longitudinally. Each wing 18, 20 further has a ramp 34 extending generally longitudinally and spaced from the oblique corner 21. The ramps 34 present the wings 18, 20 at a suitable angle to the drywall panels 2, 4 and create an interior space between the spaced ramps 34 and the flanges 28, 30 into which excess compound 8 can accumulate in the course of a swipe of the trowel 16 by an operator. The ramps 34 are in the form of a pair of steel skids that are secured to the outer face of the wings near the peaks 24. The skids are angled outwardly at the working edge 26 and are aligned inwardly at the flanges 28, 30. The skids are preferably parallel to the central axis 22 and secured by screws 36 to the body 1.

In the manufacture of the trowel 16 comprising the wings 18, 20, a central part of the blank is first subjected to the incision 32, being a long straight gap or slot formed between two small circles at either end 33. The slot 32 and the end circles 33 are laser cut. They allow the wings 18, 20 to flex during operation.

A pair of narrow ridges 37, which may have the dimensions 1.5-3 mm wide by 50-115 mm long, or more particularly about 2.5 mm×about 85 mm, are pressed into the rear face of both wings 18, 20. These are for increasing the stiffness of the wings 18, 20 at the working edge 26, thus providing a flat, smooth and planar finish. This avoids concavity in the wings 18, 20 at the working edge 26.

Nested in the small of the oblique corner 21 and beneath the incision 32 is the prism-shaped support block or bracket 38 that is about 10 mm deep. The prism block 38 is welded to the rear face of both wings 18, 20. The bracket 38 bridges the wings 18, 20 and supports an overlying steel spine block or housing 40 of triangular section. The bracket 38 has a housing 40 with parallel sides 41 and matching rebates 42 for a purpose to be described. The incision 32 allows the front working half 35 of the trowel 16 to flex, whereas the trailing elevated half 39 of the trowel 16 is not able to flex due to being rendered rigid by the steel spine or bracket 38.

The ridges 37 maintain rigidity of the wings 18, 20 over the 100 mm span of working edge 26 by being substantially aligned to the working edge 26 and located near or adjacent the leading edge of working edge 26. Otherwise, the thick compound 8 would easily make the working edge 26 concave, therefore, creating convex plaster bands that would use more compound 8, take longer drying times and require extensive sanding.

The lower half of the spine or bracket 38 has a rectangular cavity 43 and a screw 44 for clamping the spine or bracket 38 to the block 40. The upper half of the spine has a part-spherical cavity 46, which acts as a ball socket for a ball 48 of a trowel handle 52. The handle is about 1500 mm long. The ball 48 is large enough to exert friction and retain the change in angle between the handle 52 and the wings 18, 20. An inverted U-shaped spring 50 may be pushed into the rebates 42 to imprison the ball 48 in the cavity 46. Through the handle 52, the operator provides the requisite force to keep the skids or ramps 34 in contact with the wings 18, 20 faces. The spring 50 remains in position, thereby retaining the ball 48 in the cavity 46.

In operation, the bead of plaster mix 8 is deposited for the full length of the corner 5, typically about 2700 mm. The working edge 26 of the trowel 16 is placed at approximately 1000 mm from a floor and pointed toward the floor. The trowel 16 is slid upward until the elevated edge 27 almost contacts the ceiling. It is then turned around facing downward (but the operator uses the wall to turn the smoothing tool 16 around its pivoting ball 48) and slid down until the elevated edge 27 almost comes in contact with the floor. The operator flips around the rotating ball 48 (using the wall) and proceeds upwardly just past the 1000 mm start. The area of the trowel 16 between the incision 32 and the trailing working edges 26 flexes, decreasing the corner angle theta (θ) when the operator applies pressure to the handle 52. The corner angle theta (θ) of the trowel 16 starts at 105 degrees and then decreases to about 90 degrees, which accords with most house walls and ceiling cornice zones and internal wall corners, although some range between 85-105 degrees. The plaster 8 dries and is sanded and inspected.

The illustrations, photographs and drawings, if any, form part of the disclosure of this specification as does the description, illustrations, photographs and drawings of any associated provisional or parent specification or of any priority document, if any, all of which are imported hereinto as part of the record hereof.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

In the present specification, terms such as "apparatus," "means," "device," and "member" may refer to singular or plural items and are terms intended to refer to a set of properties, functions or characteristics performed by one or more items or components having one or more parts. It is envisaged that where an "apparatus," "means," "device," or "member," or similar term is described as being a unitary object, then a functionally equivalent object having multiple components is considered to fall within the scope of the term, and similarly, where an "apparatus," "assembly," "means," "device," or "member" is described as having multiple components, a functionally equivalent but unitary object is also considered to fall within the scope of the term, unless the contrary is expressly stated or the context requires otherwise.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the working edge 26 uppermost.

Finally it is to be understood that various alterations, modifications and/or additions may be incorporated into the various constructions and arrangements or parts without departing from the spirit and ambit of the disclosure.

What is claimed is:

1. A trowel for finishing internal corners formed by drywall panels, the trowel comprising:

a detachable handle, and a body comprising a pair of substantially rigid panels forming wings joined at a reflex angle at a corner having a corner axis, and presenting an L-shaped outer working surface, an attachment on the reverse surfaces being the oblique side of the wings for receiving and retaining the detachable handle, the wings each having a slot extending from a central area of the wing toward the corner, wherein the body is formed from a hexagonal sheet of metal and the slot is cut therein.

2. The trowel of claim 1, wherein the slot is in the form of an incision.

3. The trowel of claim 1, wherein the slot extends between a pair of spaced locations intermediate the wing.

4. The trowel of claim 1, wherein the slot extends from a central area of one wing to a central area of the other wing, passing through the corner.

5. The trowel of claim 1, wherein each panel member of the pair of wings is substantially planar in shape, presenting a pair of flat surfaces joined together and set at an oblique angle relative to one another.

6. The trowel of claim 1, wherein the body is formed from a single piece of material and the wings are integrally and/or unitarily formed from the same piece, the rigid wings formed by folding stainless steel to form the corner axis that the trowel relies upon for central consistent flex along a longitudinal axis and enables the trowel to apply an even spread of compound.

7. The trowel of claim 1, wherein stiffness of the wings is achieved by the provision of a pair of laterally extending ridges pressed into the body, the ridges each aligned along a working edge of the trowel.

8. The trowel of claim 7, wherein the working edge of the wings includes a flange that is inclined toward the front of the trowel.

9. The trowel of claim 8, wherein the flange lies at an obtuse angle to the working surface of each wing.

10. The trowel of claim 1, wherein the working face of each wing includes a skid for contacting the drywall panels.

11. The trowel of claim 10, wherein the skid is spaced away from, and aligned substantially parallel to, the corner axis of the working surface of the trowel.

12. The trowel of claim 11, wherein the drywall panels are coated, and the skid has an inclined face for contacting the coated drywall panels and is adapted to present the wings at a suitable smoothing angle.

13. The trowel of claim 1, wherein the detachable handle is fixed to the body by the attachment comprising a ball socket with an adjacent spring seat for a ball-retaining spring that traps a ball in the socket while allowing universal movement of the detachable handle to which the ball is fixed.

14. The trowel of claim 13, wherein the oblique side of the wings corresponds to a small of the corner, the socket is a prism-shaped spine or block with an apex opposite and aligned with a corner axis, the prism-shaped spine or block being fixed to the small of the corner to maintain stiffness and to facilitate equal flex of the wings either side of the corner.

15. The trowel of claim 1, wherein the body is formed from a sheet of steel about 1.0 mm-1.2 mm thick so that springs are not required for the wings to flex and deform resiliently to maintain sufficient stiffness, while permitting the trowel to he used to spread a viscous compound to achieve a flat and smooth finish.

* * * * *